US005095960A

United States Patent [19]

Gründler et al.

[11] Patent Number: 5,095,960

[45] Date of Patent: Mar. 17, 1992

[54] APPARATUS FOR FILLING BAGS WITH BULK MATERIAL

[75] Inventors: Bruno Gründler; Werner Müller, both of Neuhausen am Rheinfall, Switzerland

[73] Assignee: Sig Schweizerische Industrie-Gesellschaft, Neuhausen am Rheinfall, Switzerland

[21] Appl. No.: 540,558

[22] Filed: Jun. 20, 1990

[30] Foreign Application Priority Data

Jun. 20, 1989 [CH] Switzerland ..... 2290/89

[51] Int. Cl.[5] ..... B65B 3/16; B65B 41/18

[52] U.S. Cl. ..... 141/114; 141/147; 141/166; 141/314; 53/175; 53/261; 53/260

[58] Field of Search ..... 141/114, 10, 147, 166, 141/313, 314, 316; 53/175, 261, 260, 449, 459, 570

[56] References Cited

U.S. PATENT DOCUMENTS

| | | | |
|---|---|---|---|
| 2,182,187 | 12/1939 | Wagner | 53/175 |
| 3,112,777 | 12/1963 | Lohse | 141/166 |
| 3,774,509 | 11/1973 | Heinzer | 53/175 |
| 3,949,536 | 4/1976 | Chevalier | 141/114 |
| 4,033,093 | 7/1977 | Mencacci | 53/112 B |
| 4,305,242 | 12/1981 | Barathe et al. | 141/314 |
| 4,526,214 | 7/1985 | McGregor | 141/114 |
| 4,687,462 | 8/1987 | Rewitzer | 53/175 |
| 4,848,421 | 7/1989 | Froese et al. | 141/114 |

FOREIGN PATENT DOCUMENTS 1290473 3/1969 Fed. Rep. of Germany .

*Primary Examiner*—Ernest G. Cusick
*Assistant Examiner*—Keith Kupferschmid
*Attorney, Agent, or Firm*—Spencer & Frank

[57] ABSTRACT

An apparatus for filling bags with bulk material includes a filling device for consecutively charging bags with the bulk material; a traction device leading into and out of a region of the filling device; and a plurality of spaced spreading devices, carried by the traction device, for expanding each bag to facilitate charging thereof by the filling device. Each spreading device has first and second mutually cooperating pivotal spreading fingers having a retracted state and an expanded state. The apparatus further has a first cam track extending generally along the traction device; a second cam track extending generally along the first cam track and being spaced therefrom; a device connected to the first cam track for lowering each spreading device relative to the traction device to introduce the spreading fingers into a bag located below the spreading device; and a device connected to the second cam track for placing the spreading fingers of each spreading device from the retracted state into the expanded state after introduction of the spreading fingers into the bag.

6 Claims, 4 Drawing Sheets

APPARATUS FOR FILLING BAGS WITH BULK MATERIAL

CROSS REFERENCE TO RELATED APPLICATION

This application claims the priority of Swiss Application No. 2290/89-3 filed June 20th, 1989, which is incorporated herein by reference.

FIELD OF THE INVENTION

This invention relates to a method and an apparatus for filing bags with bulk material, particularly cereal products.

SUMMARY OF THE INVENTION

It is an object of the invention to provide an improved method and apparatus for filling bags, ensuring a highly satisfactory shaping of the bags and a secure flow of bulk materials which have the tendency to clog.

This object and others to become apparent as the specification progresses, are accomplished by the invention, according to which, briefly stated, a spreadable shape-forming device is introduced in the opening of a flat-folded bag in a retracted state, thereafter elements of the device are spread to expand the bag and between the spread shape-forming elements the bag is filled with the bulk goods. Thereafter the shape-forming device is removed from the bag.

DESCRIPTION OF THE PREFERRED EMBODIMENT

First the basic construction and operational principle of the invention will be described in conjunction with FIGS. 1 and 2, and thereafter a preferred structural embodiment of the apparatus will be set forth with reference to FIGS. 3, 4 and 5.

Figure 1:
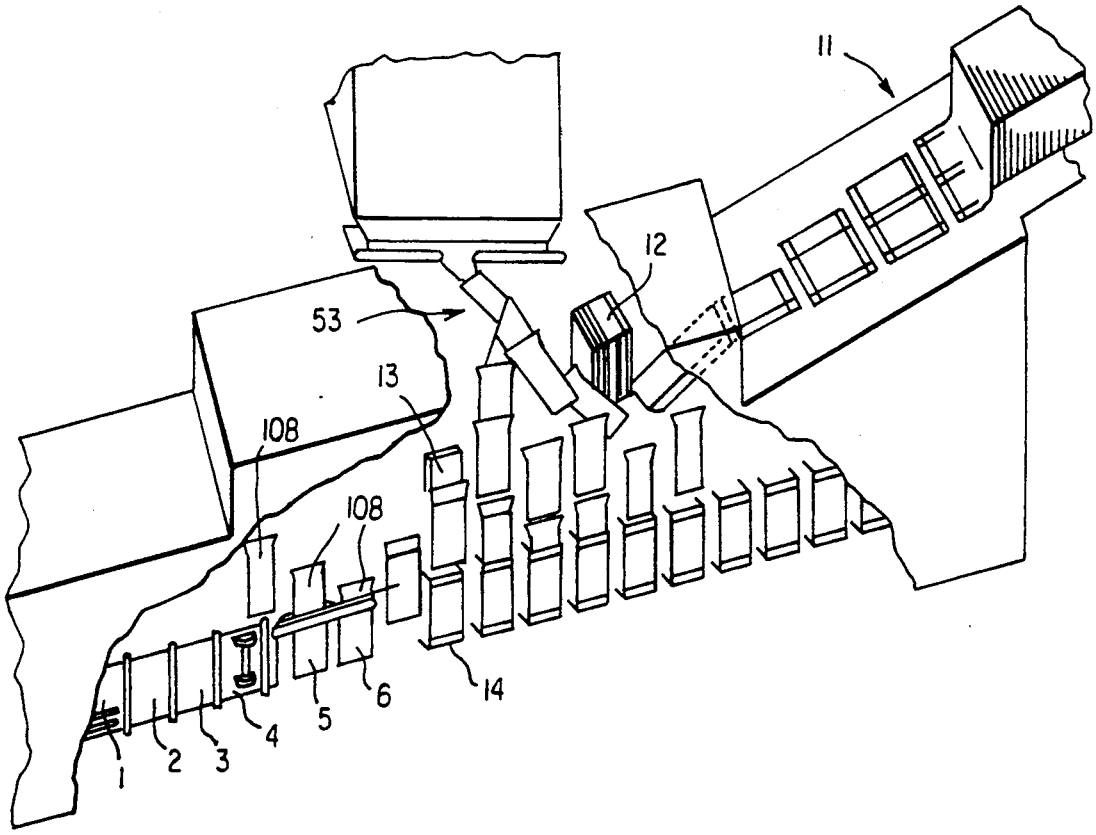
FIGS. 1 and 2 are schematic perspective views illustrating the operational principle of the invention.

Turning to FIGS. 1, the apparatus schematically shown therein makes both bags and cardboard boxes. The bag making is performed on the left side of the apparatus whereas the box making takes place on the right side as viewed in FIG. 1.

The bags may be made from a continuous heat-sealable wrapper sheet 1. It is provided with a weld seam along abutting longitudinal edges and the adjoining ends of consecutively made bags 2, 3, 4, 5 and 6 are heat-sealed and cut or otherwise separated from one another. The bags designated at 5 and 6 are shown as already separated from one another.

The cardboard boxes constitute rigid packages and are made, for example, of cardboard blanks 11 which are first closed at the bottom while the upper closure flaps remain open, preferably outwardly horizontally spread. The boxes 12, 13, 14 are formed in a known manner and brought into the vicinity of the bags. The bags 2, 3, 4, 5 and 6 are in a flat-folded state subsequent to heat sealing and separating.

In order to expand the bags, according to the invention spreading devices 108 are provided which are introduced in a closed (retracted) state into the folded bags all the way to the bottom thereof and are thereafter opened (spread) to thus expand the bag, whereby the frontal and rear panels of the bag move away from one another. As shown in FIG. 1, a closed spreading device 108 is readied for introduction into the bag 4; a closed spreading device 108 is shown in a partially introduced state relative to the bag 5, whereas spreading device 108 is fully introduced into the bag 6.

In a subsequent method step the bags are, together with the introduced and preferably still retracted spreading devices, at least partially introduced into the boxes and are then expanded within the boxes by virtue of opening (spreading) the spreading devices and are filled with the bulk material. For this purpose, the apparatus shown in FIG. 1 has a distributor 53 for filling the bags. In case the bags have been initially introduced only partially into the respective boxes, the bags are essentially entirely pushed into the boxes during the filling operation so that the bags contact or are in the immediate vicinity of the box bottom. In a further operational step the open spreading devices are withdrawn from the bags and the boxes are closed.

Figure 2:
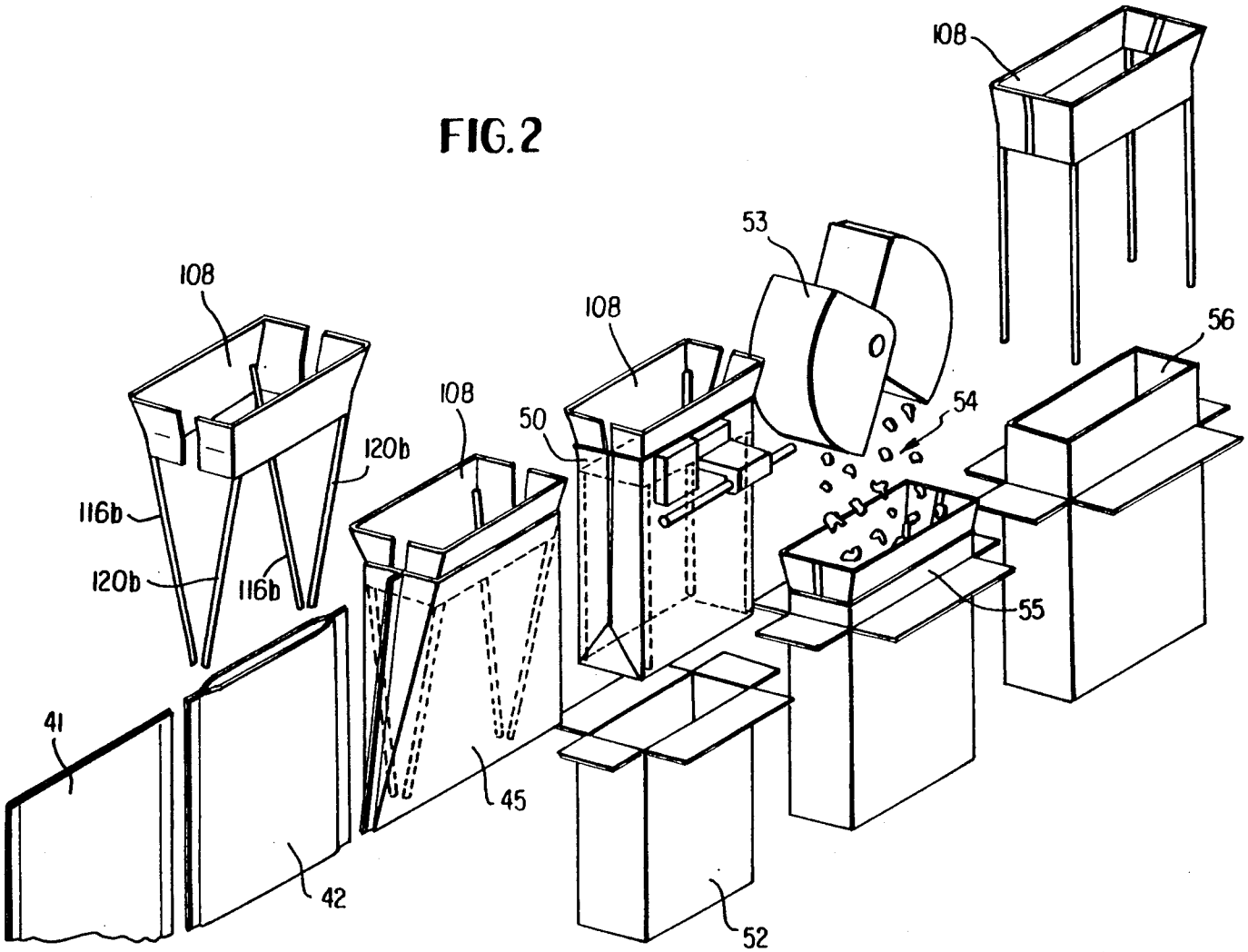

Turning now to FIG. 2, there are shown therein two pocket-like or flat-folded bags 41 and 42 as well as a retracted spreading device 108 positioned for introduction into the bag 42. A further spreading device 108 is shown in its introduced state in the bag 45.

The device 108 has four shape-forming elements or fingers **116*b*, 120*b* which may be expanded in pairs and which may be constituted by rigid bars. As illustrated in FIG. 2, in the first two devices 108** the fingers are in a retracted position in which the free ends of the fingers forming each pair almost contact. Preferably, the fingers are brought into a face-to-face engagement by virtue of flattened ends.

FIG. 2 shows an expanding device 108 which is depicted in its introduced state in the bag 50 and whose bag-shaping elements or fingers have been spread so that the bag is no longer flat or pocket-shaped but has assumed at least approximately the shape of a rectangular box. The bag 50, together with the open spreading device 108 is situated vertically above a cardboard box 52 into which it is introduced in the course of a subsequent operational step.

FIG. 2 further shows the material-distributing device 53 which discharges, for example, cornflakes or popcorn 54 into a bag 55 which has been introduced into a cardboard box. After the bag, such as bag 56, has been filled with the bulk material, the open spreading device 108 is withdrawn therefrom while, at the same time, preferably the fingers are slightly moved towards one another (that is, retracted) to facilitate such a withdrawal.

Figure 3:
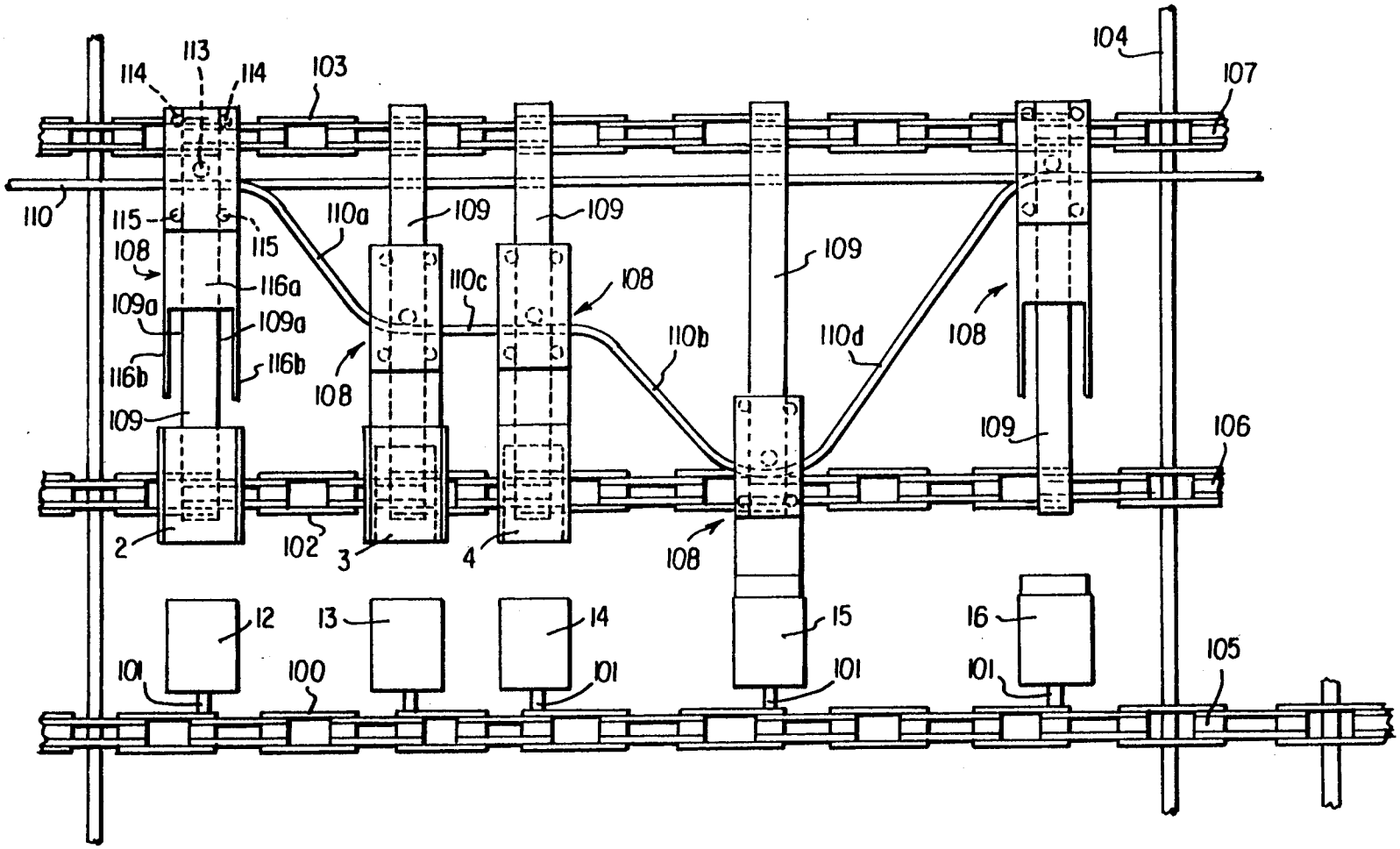
FIG. 3 is a schematic side elevational view of a preferred embodiment of the invention.

Turning now to FIG. 3, an endless horizontal chain 100 carries spaced supports 101 on which respective cardboard boxes 12, 13, 14, 15, 16 are inserted.

Vertically above the carrier chain 100 a second horizontal carrier chain 102 is provided. Non-illustrated suction means attached to the carrier chain 102 carry substantially flattened, upwardly open empty bags 2, 3 and 4. A third endless horizontal carrier chain 103 is arranged above the carrier chain 102. The carrier chains 100, 102 and 103 are driven in synchronism by a drive shaft 104 with the intermediary of respective sprockets 105, 106 and 107 meshing with the respective chains 100, 102 and 103. To the carrier chain 103 there are mounted spaced the spreading devices generally designated at 108.

Each spreading device 108 is associated with a suspension plate 109 having an upper portion secured to the carrier chain 103.

As it will be described in greater detail in conjunction with FIGS. 4 and 5, each spreading device 108 is arranged for vertical reciprocating motion along and relative to the associated suspension plate 109. For causing such a vertical displacement, a track rail 110 is provided which extends along and underneath the carrier chain 103 and which has downwardly sloping portions 110*a* and 110*b*, a horizontal portion 110*c* between the two portions 110*a* and 110*b*,as well as an ascending portion 110*d*.

The spreading device 108 will now be described in detail with reference to FIGS. 3 and 4.

A rigid frame 111 is affixed to a carrier plate 112 which supports a roller 113 running on the track rail 110 as well as vertically aligned rollers 114 and 115 engaging and guided by opposite vertical edges 109*a* of the suspension plate 109.

A spreader element 116 is fixedly attached to an arm 117 which, in turn, is articulated by a pivot pin 117*a* to the frame 111. One free end of the arm 117 carries a roller 118 which runs on the underface of a rail 119 extending underneath and along the track rail 110. It will be apparent from FIG. 4 that if the distance of the running face of the rail 119 changes relative to the running face of the track rail 110, the lever 117 and thus also the spreading element 116 will execute a pivotal motion about pivot pin 117*a*.

A further spreading element 120 is fixedly attached to an arm or link 121 which is pivotally secured to the frame 111 by a pivot 121*a*. The opposite end of the arm 121 has a slot 123 receiving a pin 124 affixed to another free end of the arm 117. Thus, as the arm 117 (and the spreading element 116) swing about the pivot 117*a*, the pin 124 will cause a pivotal motion of the arm 121 (and the spreading element 120) about the pivot 121*a* in a sense opposite to the pivotal motion of the arm 117 about the pivot 117*a*.

The spreading elements 116 and 120 have respective continuous panels 116*a* and 120*a*, respectively. From opposite lower ends of the panel 116*a* there extend downwardly two parallel-spaced fingers 116*b* (both fingers 116*b* are shown in FIG. 3 while only one is visible in FIG. 4). Similarly, from opposite lower ends of the panel 120*a* there extend downwardly two parallel-spaced fingers 120*b* (none is visible in FIG. 3 and only one is visible in FIG. 4).

Figure 4:
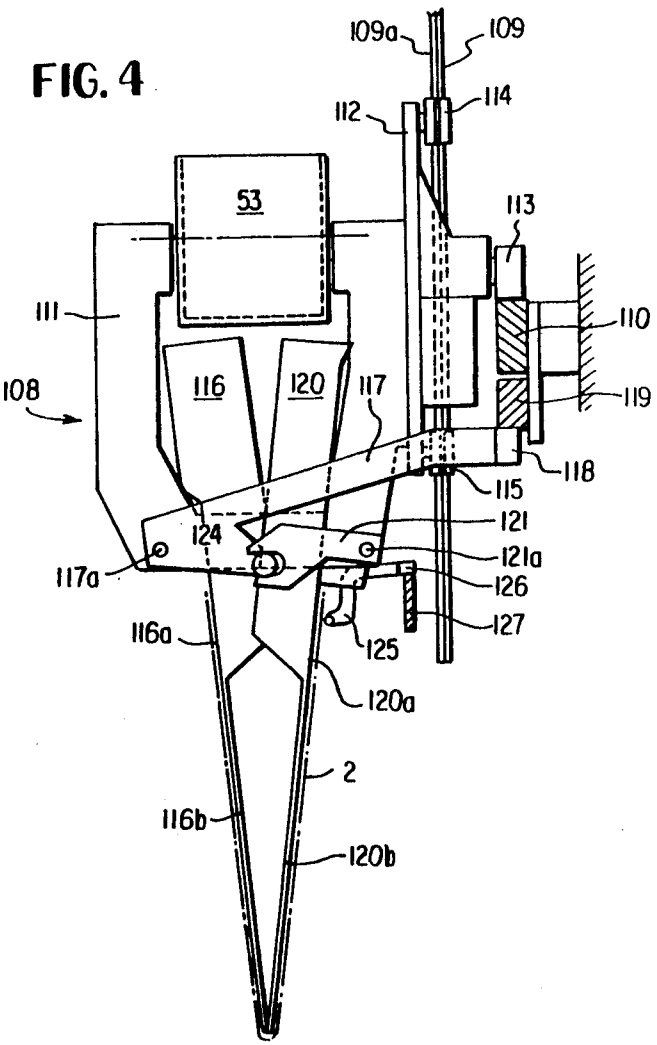
FIG. 4 is a front elevational view of a spreading device according to the preferred embodiment, illustrated at an enlarged scale relative to FIG. 3 and depicted in a retracted state.

FIG. 4 depicts the spreading elements 116 and 120 in a retracted position in which the lowermost ends of the fingers 116*b* and 120*b* contact. This position corresponds to the retracted position illustrated in FIG. 2 for the spreading elements 43 and 44.

The spreading device 108 is depicted as being situated in the zone of the material distributing device 53 (also shown in FIG. 2).

Figure 5:
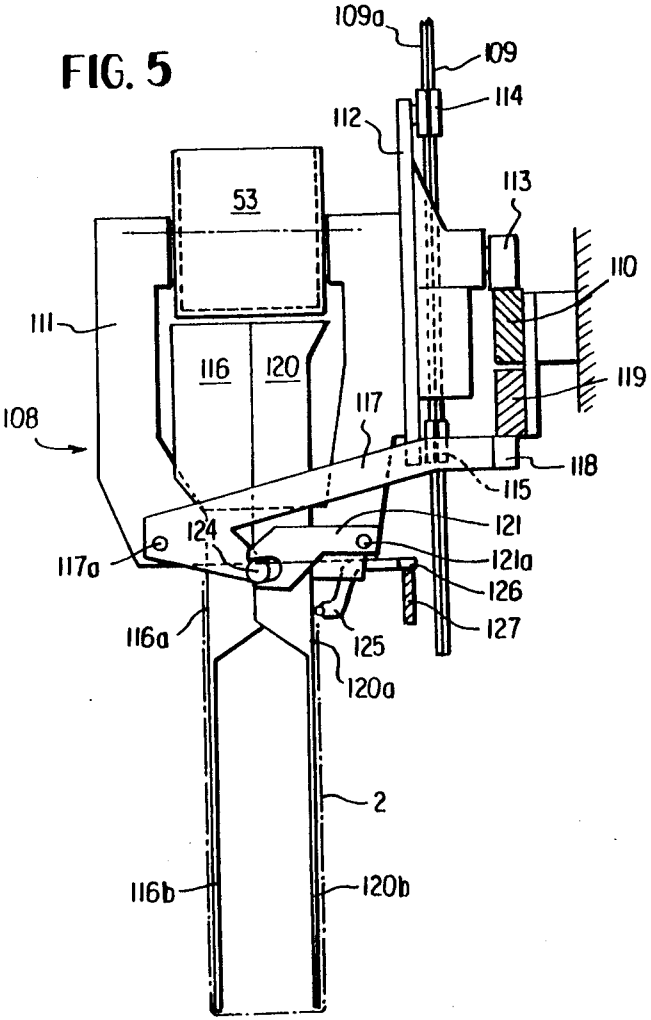
FIG. 5 is a view similar to FIG. 4, depicting the device in a spread state.

FIG. 5 illustrates the spreading device 108 in its expanded state, that is, where the spreading elements 116 and 120 have been simultaneously pivoted in a scissors-like manner such that the fingers 116*b* and 120*b* are moved away from one another and assume a generally parallel orientation. This position corresponds to the expanded (spread) position illustrated in FIG. 2 for the spreading elements 51 and 57. The movement of the spreading elements 116 and 120 from the position shown in FIG. 4 into the position shown in FIG. 5 has occurred by virtue of an increase of the distance between running faces (cam tracks) of the two rails 110 and 119. As a result of such an increase, the roller 118 is depressed whereupon the arm 117 and the spreading element 116 have turned clockwise and, at the same time, as a result of the cooperation between the pin 124 and the slot 123, the arm 121 and the spreading element 120 have turned counterclockwise.

The operation of the apparatus will now be set forth with reference to FIGS. 3, 4 and 5.

As the spreading devices 108 are carried carousel fashion by the endless carrier chain 103, they arrive sequentially in the operative zone represented by the leftmost spreading device 108 as viewed in FIG. 3. Vertically aligned with that spreading device 108 is a flattened bag 2 carried by the carrier chain 102 and a box 12 carried by the carrier chain 100. As the leftmost spreading device 108 continues its travel towards the right, the rail 110 changes its horizontal course to the downwardly sloping course 110*a* and, as a result, the spreading device 108 moves vertically downwardly relative to the suspension plate 109 as the roller 113 follows the downward path of the rail portion 110*a*. In this phase, the spreading elements 116 and 120 are in their retracted position as illustrated in FIG. 4.

During the downward movement of the spreading device 108 relative to the suspension plate 109, the fingers 116*b* and 120*b* enter the bag, as shown in FIG. 3 for the second spreading device 108 and the bag 3.

Along the horizontal rail portion 110*c* the running face (cam track) of the rail 119 has a course which moves away downwardly from the running face (cam track) of the rail 110. This is effected by a downwardly increasing height of the rail 119 as may be observed by comparing FIGS. 4 and 5. This, as it was explained earlier, causes the spreading fingers 116*b* and 120*b* to assume their position shown in FIG. 5, spreading the bag open. As the spreading element 120 assumes its position shown in FIG. 5, the bag 2 is clamped against the panel 120*a* by a bag holder 125 which has a roller 126 travelling on a rail 127. A downward slope of the running face of the rail 127 will cause the bag holder to pivot clockwise and clamp the bag 2 against the panel 120*a* of the spreading element 120.

By virtue of the second descending portion 110*b* of the rail 110, the spreading device 108 moves further downwardly with the spread bag which, during this portion of the travel is gradually introduced into the respective travelling box as shown for the box 15 underneath the lowest zone of the rail 110. In this zone a filling of the bag, placed in the box 15 occurs from the material distributing device 53 (not shown in FIG. 3).

Thereafter, the roller 113 will travel upwardly on the ascending portion 110*d* of t he rail 110 and thus the spreading device 108 is gradually withdrawn from the bag which remains in the box carried by the chain 100. In this ascending zone the running face of the rail 119 approaches the running face of the rail 110 so that t he arm 117 will execute a counterclockwise pivotal motion, whereupon the spreading fingers 116*b* and 120*b* assume gradually their retracted position shown in FIG. 4. In this position the upward removal of the spreading device 108 from the bag is facilitated.

At the end of the ascending portion 110*d* the rail 110 continues its horizontal, elevated course and thus the spreading devices 108 will be carried around in a carousel fashion to return once again into the operative zone. The filled bags, positioned in the respective boxes, are carried by the chain 100 to a further package processing station.

It will be understood that the above description of the present invention is susceptible to various modifications, changes and adaptations, and the same are intended to be comprehended within the meaning and range of equivalents of the appended claims.

What is claimed is:

1. An apparatus for filling bags with bulk material comprising (a) filling means for consecutively charging bags with the bulk material;

(b) a traction device leading into and out of a region of said filling means;

(c) a plurality of spaced spreading devices, carried by said traction device, for expanding each bag to facilitate charging thereof by said filling means; each spreading device including (1) a support attached to said traction device and having a vertical guide face;

(2) a frame guided by the vertical guide face for vertical movement relative to said support;

(3) a first guide roller mounted on said frame;

(4) first and second mutually cooperating spreading fingers pivoted to said frame; said spreading fingers having a retracted state and an expanded state;

(5) an arm pivoted to said frame for a pivotal motion in a vertical plane; said arm being operatively connected to said fingers for pivoting said fingers into said retracted state or into said expanded state dependent upon a direction of motion of said arm;

(6) a second guide roller mounted on said arm;

(d) a first cam track extending generally along said traction device; said first guide roller being in engagement with said first cam track for being supported and guided by said first cam track; said first cam track having a descending portion leading toward said region of said filling means for causing said first roller to move downwardly relative to said support, causing said frame to move vertically downwardly, whereby said spreading fingers are introduced into a bag located below said spreading device; said first cam track having an ascending portion leading away from said region of said filling means for causing said first roller to move upwardly relative to said support, causing said frame to move vertically upwardly, whereby said spreading fingers are withdrawn from the bag; and (e) a second cam track extending generally along said first cam track; said second am track having first and second portions being at different distances from said first cam track; said second guide roller being in engagement with said second cam track for being guided by said second cam track; said arm being in a first pivotal position when said second guide roller is on said first portion and in a second, different pivotal position when said second guide roller is on said second portion; said arm causing said spreading fingers to assume said retracted state in said first pivotal position of said arm and said arm causing said spreading fingers to assume said expanded state in said second pivotal position of said arm.

2. An apparatus as defined in claim 1, further comprising stationarily supported first and second rails; said first rail containing said first cam track and said second rail containing said second cam track.

3. An apparatus as defined in claim 2, wherein said second rail has a varying height.

4. An apparatus as defined in claim 3, wherein said first and second rails extend parallel to one another.

5. An apparatus as defined in claim 1, wherein said arm is fixedly attached to said first spreading finger; further comprising a link fixedly attached to said second spreading finger and pivoted to said frame; and an articulating means joining said arm to said link for transmitting a torque from said arm to said link upon pivotal motion of said arm to effect a pivotal motion of said link and said second spreading finger in a sense opposite to the pivotal motion of said arm and said first spreading finger.

6. An apparatus for filing bags with bulk material comprising (a) filling means for consecutively charging bags with the bulk material;

(b) a traction device leading into and out of a region of said filling means;

(c) a plurality of spaced spreading devices, carried by said traction device, for expanding each bag to facilitate charging thereof by said filling means; each spreading device including (1) a support attached to said traction device;

(2) a frame guided for vertical movement along and relative to said support;

(3) a first guide member mounted on said frame;

(4) first and second mutually cooperating spreading fingers pivoted to said frame; said spreading fingers having a retracted state and an expanded state;

(5) an arm pivoted to said frame for a pivotal motion relative to said frame; said arm being operatively connected to said fingers for pivoting said fingers into said retracted state or into said expanded state dependent upon a direction of motion of said arm;

(6) a second guide member mounted on said arm;

(d) a first cam track extending generally along said traction device; said first guide member being in engagement with said first cam track for being supported and guided by said first cam track; said first cam track having a descending portion leading toward said region of said filling means for causing said first guide member to move downwardly relative to said support, causing said frame to move vertically downwardly, whereby said spreading fingers are introduced into a bag located below said spreading device; said first cam track having an ascending portion leading away from said region of said filling means for causing said first guide member to move upwardly relative to said support, causing said frame to move vertically upwardly, whereby said spreading fingers are withdrawn from the bag; and (e) a second cam track extending generally along said first cam track; said second cam track having first and second portions being at different distances from said first cam track; said second guide member being in engagement with said second cam track for being guided by said second cam track;

said arm being in a first pivotal position when said second guide member is on said first portion and in a second, different pivotal position when said second guide member is on said second portion; said arm causing said spreading fingers to assume said retracted state in said first pivotal position of said arm and said arm causing said spreading fingers to assume said expanded state in said second pivotal position of said arm.

* * * * *